United States Patent [19]

Jensen

[11] Patent Number: 4,928,867

[45] Date of Patent: May 29, 1990

[54] SYSTEM FOR POSITIONING FASTENERS

[76] Inventor: Mark B. Jensen, 1656 N. Sunview, Mesa, Ariz. 85205

[21] Appl. No.: 376,207

[22] Filed: Jun. 30, 1989

Related U.S. Application Data

[63] Continuation-in-part of Ser. No. 135,605, Dec. 21, 1987, abandoned.

[51] Int. Cl.[5] ..... B25C 1/00; B25C 7/00

[52] U.S. Cl. ..... 227/7; 227/32; 227/156; 227/130

[58] Field of Search ..... 227/4, 5, 6, 7, 8, 120, 227/156, 82, 32, 130

[56] References Cited

U.S. PATENT DOCUMENTS

| | | | |
|---|---|---|---|
| 4,291,996 | 9/1981 | Gilb | 403/14 |
| 4,630,766 | 12/1956 | Steeves et al. | 227/8 |
| 4,738,071 | 4/1988 | Ezard | 227/82 |

*Primary Examiner*—Paul A. Bell

*Attorney, Agent, or Firm*—Cassidy, Vance & Tarleton

[57] ABSTRACT

A connector (10) for positioning fasteners (16) in a preformed opening (24) in a wall (12). Tabs (18) formed on the front surface (13) of the wall (12) guide the nail gun (22) and trip a trigger mechanism to cause the fastener (16) to be driven through the wall (12) and into an abutting structural member.

The system further includes a nail gun (59) having a follower plate (94) pivotally mounted in channels (89) formed on each side of a foot (79). Each follower plate (94) is guided into contact with a tab (116) that pivots the follower plate (94) into contact with a mounting plate (75) attached to a linking arm (68) that enables activation of a pneumatic nail driving device (62) and the ejection of a nail through a predetermined position on the connector (118).

35 Claims, 7 Drawing Sheets

SYSTEM FOR POSITIONING FASTENERS

This application is a continuation-in-part application based on prior copending application Ser. No. 07/135,605, filed on Dec. 21, 1987, now abandoned.

TECHNICAL AREA

This invention pertains to devices for poisitoning faterners, and, more particularly, to a powered fastener driving tool that cooperates with a connector to position and automatically drive a fastener through a predetermined position on the connector.

BACKGROUND OF THE INVENTION

Connectors are used to join structural frame members, particularly wooden frame members, in fixed spatial relationship with respect to one another, and to transfer loads from one structural member to another. Conventional connectors consist of metal sheet or plate formed to have one or more walls for attachment to the frame members. Fasteners, such as nails, are driven through holes in the connector walls and into the abutting frame members. While the fasteners are usually driven in by hand through pre-punched holes in the connector, they may also be driven directly through the metal, either by hand or with a powered fastener driving tool. The most common power fastener tools are pneumatically or electrically powered, although hydraulic or exploding cartridge tools and their associated fateners have enough strength to penetrate lighter gauge metals, metals heavier than 16 gauge are too thick for many power tools and typical common wire nails, and prepunched holes are required.

There are several disadvantages associated with these prior art connectors. In connectors without preformed openings, there is no way to guide the power-driven fasteners to the same location each time a connector is installed. In other words, similar type connectors will not be uniformly installed. As a result, one connector may have less nails placed through it than another connector. In addition, the fasteners that are installed too close to the edge of the connector, or in other undesirable locations, will lose their effectiveness, thus jeopardizing the integrity of the structure. The use of power-driven fastener tools increases the risk of improperly positioning the fastener because of the difficulty in aligning and sighting the tool.

Larger load applications that utilize thicker than 16 gauge metal with preformed openings for fastener placement must have fasteners driven by hand, especially in the case where nails are used. This is very time consuming, particularly on face mount joist hangers and flat straps. Because of these drawbacks, wooden frame members with metal connectors are often not considered in the design and construction of large buildings. These and other disadvantages are overcome in the present invention.

SUMMARY OF THE INVENTION

The present invention is directed to a system for positioning and driving fasteners through a predetermined position on a connector. The system comprises a device for positioning fasteners, the device having at least one wall with a front surface and a back surface and an alignment member formed on the front surface; and a tool for driving fasteners, the tool including a powered fastener driving device, a trigger for activating the powered fastener driving device, a safety mechanism that cooperates with the trigger for permitting actuation of the trigger and activation of the powered fastener driving device, and an alignment foot attached to the safety mechanism that is sized and shaped to engage the alignment member on the connector for aligning a fastener with the predetermined position on the connector prior to activation of the powered fastener driving device and for causing the safety mechanism to actuate the trigger and thereby activate the powered fastener driving device.

In accordance with another aspect of the present invention, the alignment foot comprises a cylinder having an axial bore that is attached to the safety mechanism so that a fastener will be driven axially through the cylinder bore.

In accordance with another aspect of the present invention, the alignment member comprises a raised ring formed concentrically about the predetermined position and projecting above the front surface.

In accordance with another aspect of the present invention, the alignment member comprises a groove circumscribing the predetermined position and projecting below the front surface.

In accordance with yet another aspect of the present invention, the alignment member comprises an outer raised ring and an inner raised ring formed concentrically with the predetermined position and projecting above the front surface to form a groove therebetween.

In accordance with another aspect of the present invention, the alignment member comprises at least one arcuate raised ridge formed concentrically with the predetermined position.

In accordance with yet another aspect of the present invention, the alignment member comprises at least one arcuate groove formed in the front surface concentrically with the predetermined position.

In accordance with still yet another aspect of the present invention, the alignment member comprises at least three raised projections spaced equidistantly about the predetermined position and projecting above the front surface.

In accordance with yet still another aspect of the present invention, the predetermined position comprises an opening formed in the wall of the connector and the alignment member comprises a raised dimple formed on the wall concnetrically with the opening and projecting above the front surface.

In accordance with an alternative embodiment of the present invention, a tool for driving fasteners through a predetermined position on a connector is provided. The connector has one or more tab members projecting above the front surface. The tool comprises an ejection means for ejecting a fastener from the tool and a triggering means for triggering the ejection means. The triggering means includes a follower means that cooperates with the tab members for permitting the triggering means to trigger the ejection means when the fastener is aligned with the predetermined position.

In accordance with still yet another aspect of the present invention, the trigger means comprises a manually operated trigger coupled to the ejecting means and the follower means such that when the trigger is manually operated, the ejecting means will not eject a fastener until the follower means contacts the one or more tab members on the connector.

In accordance with another aspect of the present invention, the follower means comprises a linking arm coupled to the trigger and at least one follower plate pivotally mounted to a foot that is rigidly attached to the tool, the follower plate cooperating with the linking arm such that as the foot is placed on the connector and moved to bring the follower plate into contact with the one or more tab members on the connector, the follower plate pivots into contact with the linking arm to activate the ejecting means.

In accordance with the present invention, a device for positioning fasteners is provided. The fasteners are driven by a powered fastener tool, the tool being actuated by a trigger mechanism to cause a fastener to be driven through the connector into an abutting structural member. The device comprises at least one wall, the wall having a front surface on which the powered fastener tool is placed and a back surface to which the structural members bear against. A tripping means is on the front surface for tripping the trigger mechanism when the tool si brought into engagement with the tripping means, thus causing a fastener to be driven through a predetermined position on the wall and into a structural member abutting the back surface of the wall to thereby fasten the connector to the structural member.

In accordance with another aspect of the present invention, the tripping means comprises one or more tabs formed on the front surface of the wall. Preferably the tabs are aligned with the predetermined position on the wall.

In accordance with yet another aspect of the present invention, the predetermined position comprises an opening in the wall for receiving the fastener.

In accordance with an alternative embodiment of the present invention, the device comprises at least one wall, the wall having a front surface and a back surface, one or more openings formed in the wall, the openings sized to permit the passage of a fastener completely through the wall, and a tripping means on the fron surface for tripping the trigger mechanism when the tool is brough into engagement with the tripping means, thus causing a fastener to be driven through the opening, and thus completely through the wall, and into a structural member abutting the back surface of the wall.

As will be appreciated from the foregoing description, the system of present invention probide a connector that guides a powered fastener tool to the correct location and then cooperates with an alignment device or the tool to drive a fastener into a predetermined position on the connector and an abutting structural member. This invention will significantly decrease installation time while insuring proper and consistent placement of fasteners. Furthermore, powered fastener tools can be used to install heavy gauge connectors, thus enhancing the application of heavy duty connectors.

BRIEF DESCRIPTION OF THE DRAWINGS

The foregoing and other features and advantages of the present invention will become more readily appreciated as the same becomes better understood by reference to the following detailed description when taken in conjuction with the accompanying drawings wherein.

DESCRIPTION OF THE PREFERRED EMBODIMENT

Figure 1:
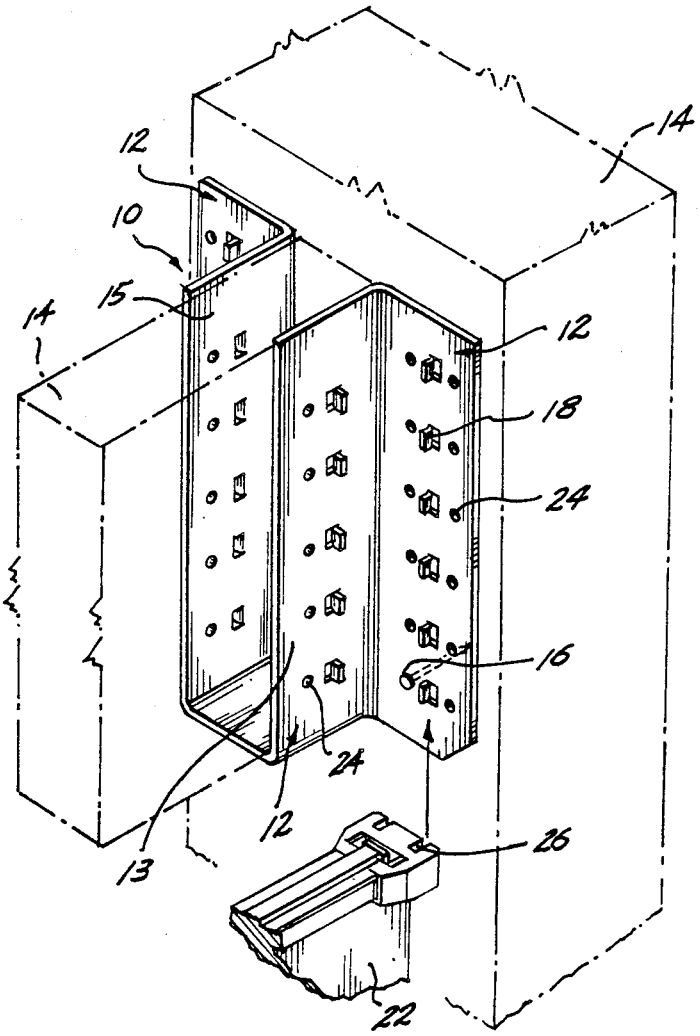
FIG. 1 is a isometric view of a preferred embodiment of a device for positioning fasteners formed in accordance with the present invention.

FIG. 1 illustrates a representative emobidment of a device for positioning fasteners in the form of a connector 10 fromed in accordance with the present invention. The connector 10 has a plurality of walls 12 formed at substantially right angles with respect to each other. Each wall 12 has a front surface 13 and a back surface 15. Wooden frame members 14 bear against the back surface 15. Fasteners in the form of nails 16 have been driven through preformed openings 24 in the walls 12 and into the abutting frame member 14 to attach the connector 10 to the frame member 14.

Tabs 18 are located at predetermined points on the wall 12. The tabs 18 are preferrably formed by bending portions of the wall 12 outward to depend substantially prependicularly from the front surface 13. Each tab 18 cooperates with a powered fastener tool to drive the nails 16 through predetermined positions in the walls 12. In this case the tabs 18 are aligned with the preformed openings 24 in the walls 12. Generally, connectors formed from metal of greater thickness than 16 gauge will require preformed openings 24 to permit the nails 16 to pass into the wall 12. Connectors formed of plastic or other brittle material will also require openings for the nails. In addition, although nails are shown here, it is to be understood that other fasteners such as screws or rivets may be used.

The tabs 18 are positioned on the walls 12 such that as the nail gun 22 passes along the walls 12 the tabs 18 engages a trigger mechanism (not shown) in the nail gun 22 to thereby trip the trigger mechanism and actuate the gun. This will cause a nail 16 to be driven only when it is aligned with the predetermined position, in this case the opening 24. In addition, the tabs 18 function to guide the nail gun 22 as the channels 26 of the gun engage the tabs 18. The openings 24 may be positioned on both sides of the tabs 18 to permit the nail gun 22 to approach the openings 24 from either direction, i.e., either direction lateral to the tabs 18.

Figure 2:
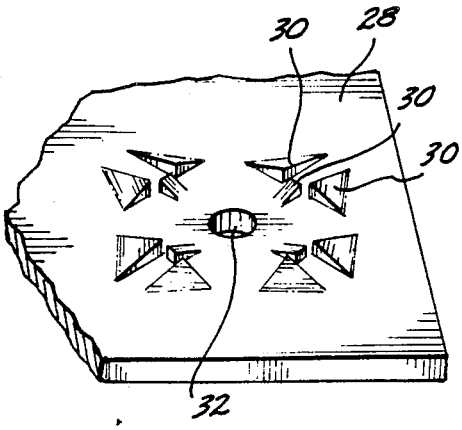
FIG. 2 is an isometric view of a portion of an alternative embodiment of a device for positioning fasteners formed in accordance with the present invention.

FIG. 2 illustrates an alternative embodiment fo the present invention wherein the wall 28 of the connector has projections 30 placed at selected positions around the opening 32. This configuration gives greater flexibility in the direction of approach by the nail gun. In other words, the nail gun may approach the opening 24 from the four directions corresponding to the four projections 30. It is to be understood that other methods may be used to trip the trigger mechanism of a nail gun, such as engagement of the nail gun with the opening itself. In addition, optical or magnetic devices may be used.

Figure 3:
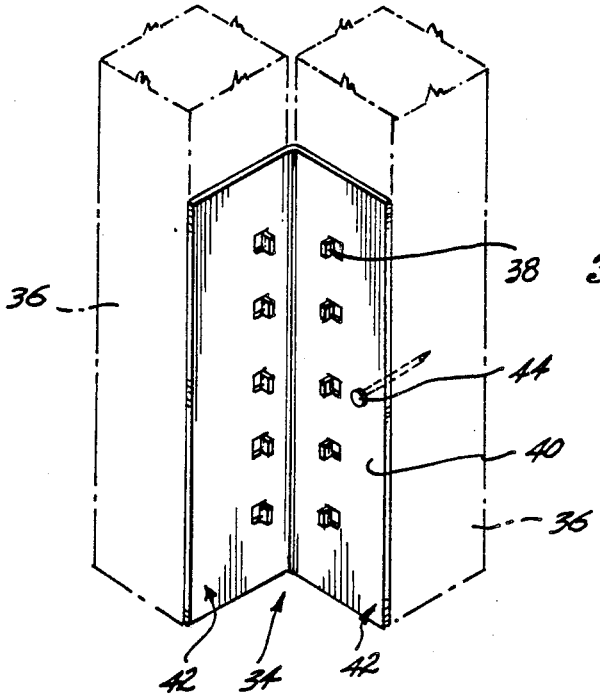
FIG. 3 is an isometric view of yet another alternative embodiment of a device for positioning fasteners formed in accordance with the present invention.

Another alternative embodiment is shown in FIG. 3 wherein the connector 34 is attached to the wooden frame members 36 by a fastener, nail 44. Tabs 38 are formed at predetermined locations on the front surfaces 40 of the walls 42. No openings are formed in the walls 42; rather, the nail 44 is driven directly through the wall 42 and into the wooden frame member 36. This configuration has the advantage of not requiring the formation of openings in the connector 34, achieving a cost savings in the manfuacture of the device, and giving greater strength to the walls 42.

Figure 4:
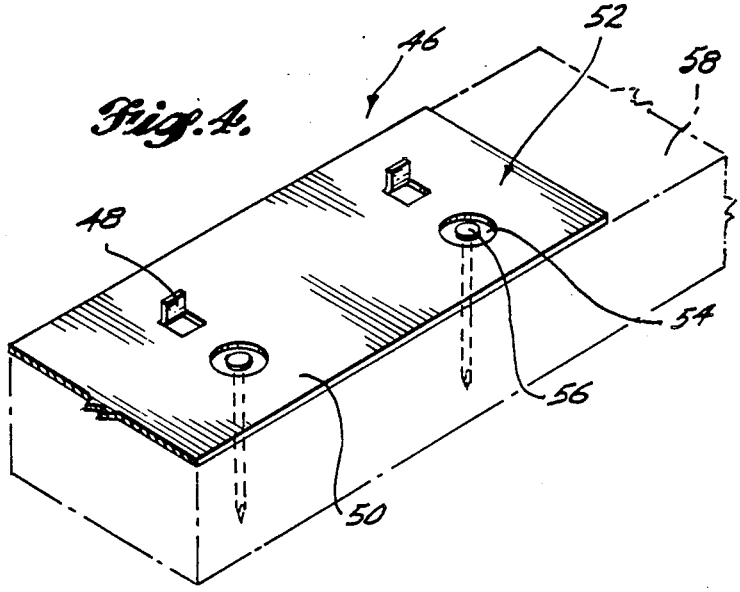
FIG. 4 is an isometric view of still another alternative embodiment of a device for positioning fasteners formed in accordance with the present invention.

The present invention has additional applications. FIG. 4 illustrates a guide plate 46 for positioning fasteners. The guide plate 46 has tabs 48 formed to depend sbustantially from the front surface 50 of the base 52. The openings 54 formed in the base 52 are sized to permit the head of a nail 56, or other fastener, to pass completely through the base 52 and bear directly against the wooden frame member 58. The use of the over-sized openings 54 enables accurate spacing of the nails and then removal of the guide plate 46. The tabs 48 function as described in the three previous embodiments.

To prevent movement of the guide plate 46 as the nail gun passes over and interacts with the tabs 48, small spurs (not shown) may be formed on the back surface 60 of the base 52. The spurs will project into the frame member 58 when the guide plate 46 is placed thereon, thereby preventing movement of the guide plate 46 while allowing easy removal by simply lifting the guide plate free of the frame member 58. The openings 54 may be manufactured to accomodate fasteners for a particular application, such as in one uniform size, or in alternating sizes.

Figure 5B:
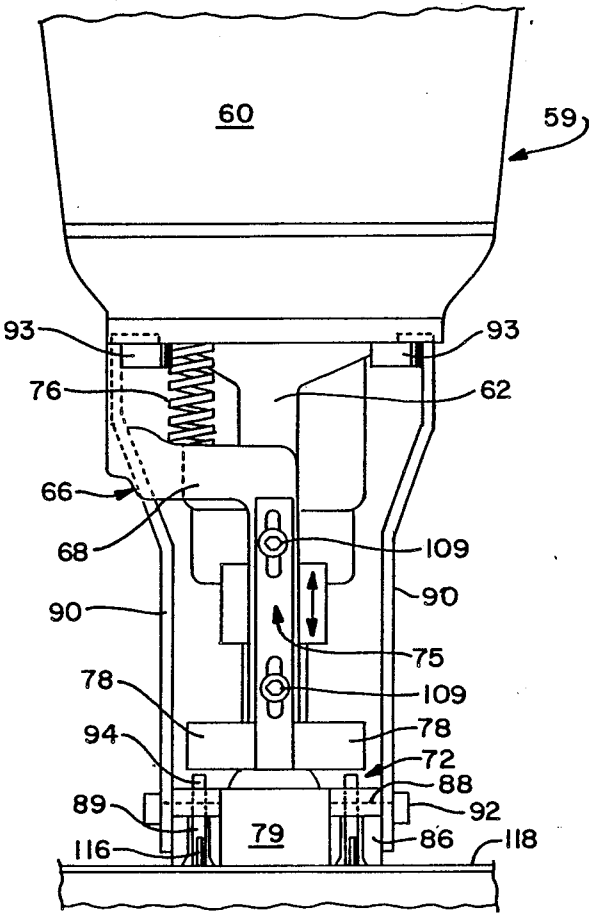
FIG. 5B is a front elevational view of the powered fastener tool of FIG. 5A.
Figure 5A:
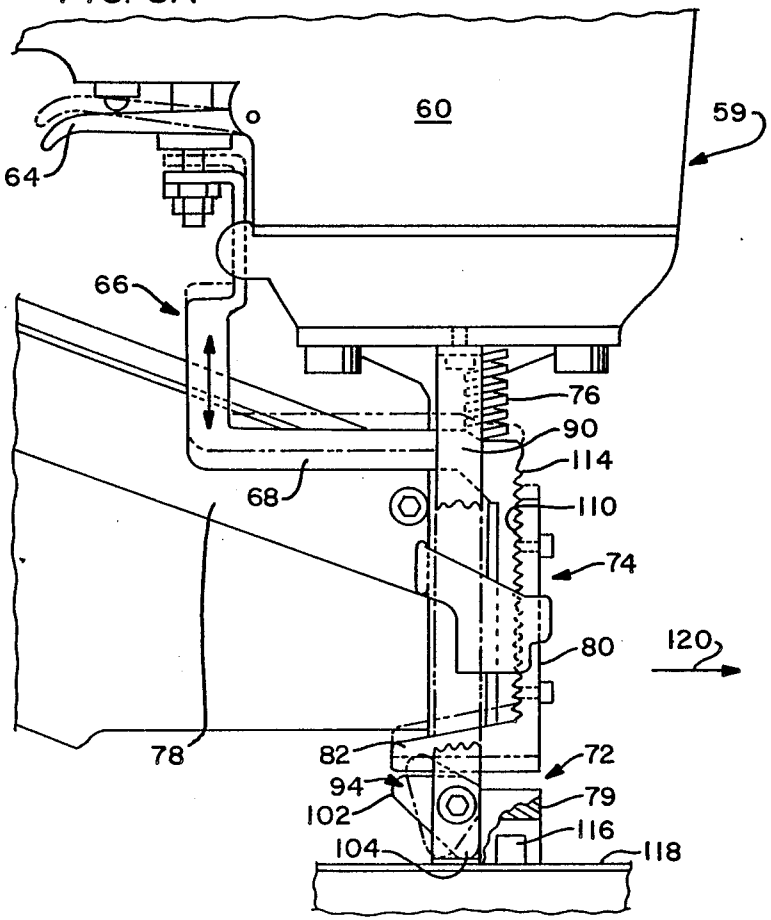
FIG. 5A is a side view in partial cross section of a powered fastener tool having an alignment and triggering attachment formed in accordane with the present invention.

Referring next to FIGS. 5A and 5B, a pneumaticpowered nail gun 59 is illustrated. The nail gun 59 shown in the representative embodiment is manufactured by Hitachi-Koki, located in Tokyo, Japan, and is identified as Model Number NR83A. It is to be understood that other nail guns may be modified in accordance with the teachings of the present invention and used as described herein. Because these nail guns are commercially available, the nail gun 59 of FIGS. 5A and 5B will not be described in detail. Briefly, the nail gun 59 has a housing 60 in which is mounted a pneumatic nail driving device, identified generally as 62. A trigger 64 mounted on the housing 60 cooperates with a safety mechanism 66 to activate the nail driving device 62.

The safety mechanism 66 includes a linking arm 68 operatively coupled to the trigger 64 and/or the device 62, the other end extending downward from the housing towards a connector 118. When the nail gun 59 is held above the connector 118, the linking arm 68 is urged downward by a helical compression spring 76. In this configuration, the trigger 64 can be squeezed, but the nail driving device 62 will not be activated. Only when the linking arm 68 is brought into positive engagement with the connector 118 and the spring 76 is compressed by downward pressure on the nail gun 59 can the trigger 64 then activate the nail driving device 62 and a nail be ejected.

In the present invention, the safety mechanism 66 is modified to utilize a unique alignment and trigger assembly 72 attached to the linking arm 68 near the nose 74 of the nail gun 59. Also shown near the nose 74 is a magazine 78 in which nails are stored.

Figure 6A:
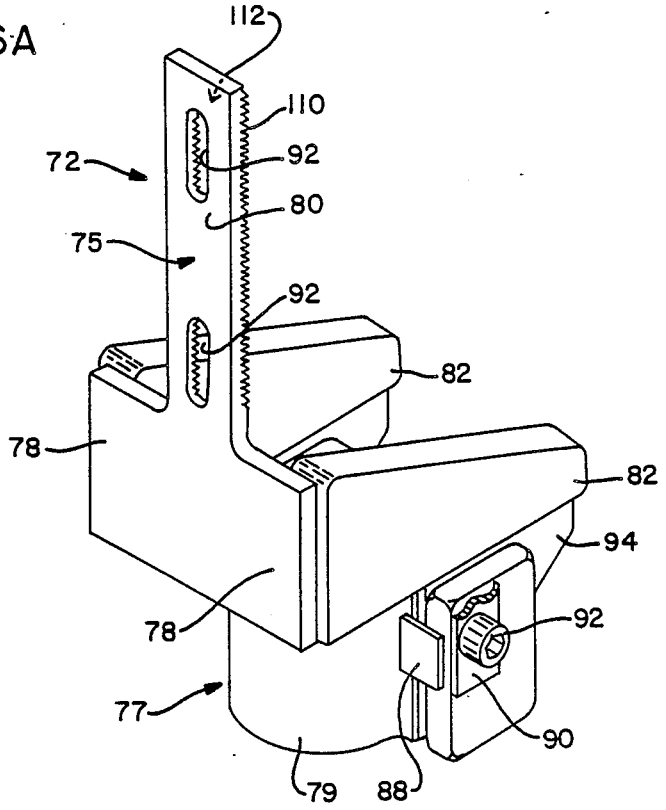
FIG. 6A is an isometric view of a partial assembly of the attachement illustrating the follower and guide plates.
Figure 6B:
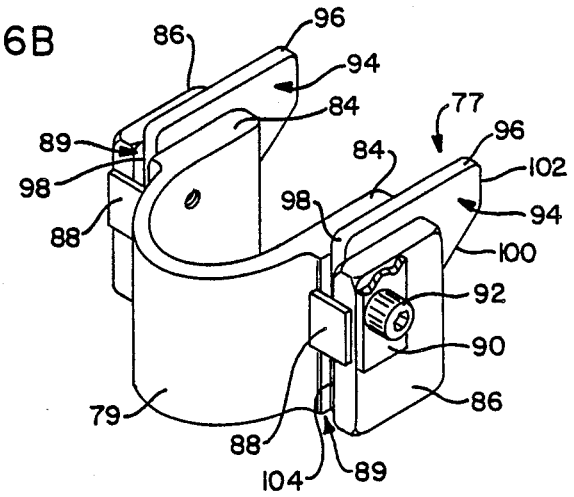
FIG. 6B is an isometric view of the alignment and triggering attachment formed in accordance with the present invention.

As shown in greater detail in FIGS. 6A and 6B, the alignment and trigger assembly 72 includes a mounting plate 75 and a foot assembly 77. The mounting plate 75 is in the shape of an inverted T having horizontally extending arms 78 and a vertically extending stem 80. A pair of spaced-apart parallel legs 82 project outward horizontally from the arms 78 over a pair of channels 89 formed on the foot assembly 77.

The foot assembly 77 includes a foot 79 that is generally U-shaped having thick, reinforced ends 84. Spaced outward from and in parallel relationship to each end 84 is a side plate 86 that is held in position by a brace 88 to form the channels 89. Each brace 88 and side plate 86 may be attached to the foot 79 by welding or may be integrally formed therewith.

The foot 79 is attached to the housing 60 by a pair of brackets 90 that rigidly hold the foot 79 in place. A bolt 92 is threadably received in the side plate to fasten the foot 79 to each bracket 90. The brackets 90 are in turn attached to the housing 60 by threaded fasteners 93. The bolts 92 project through the channels 89 to function as a pivot pin for a follower plate 94 that is pivotally mounted thereon.

Each follower plate 94 is generally triangular in shape, having a top side 96, a front side 98 that meets the top side 96 at substantially a right angle, and an angled side 100 that meets the top side 96 and front side 98 at an upper corner 102 and a lower corner 104 respectively. The follower plate 94 is mounted in the channel 89 so that as the lower corner 104 pivots away from the brace 88, the upper corner 102 swings upward and the top side 96 contacts the horizontally extending leg 82 on each side of the mounting plate 75.

The mounting plate has two oblong openings 92 through which fasteners 109 (shown in FIGS 5A and 5B) pass to attach the mounting plate 75 to the linking arm 68. Serrations 110 on the rear face 112 of the stem 80 mesh with similar serrations 114 formed on the linking arm 68. The serrations 110 and 114 permit fine adjustment in the vertical positioning of the mounting plate 74 in relation to the rigidly mounted foot assembly 77.

The operation of the alignment and trigger assembly 72 will now be described in conjunction with FIGS 5A and 5B. The connector 118 has a tab 116 that projects upward from a front or top surface 119. The foot 79 on the nail gun 59 is brought to the connector 118 to rest on the top surface 119 with the channels 89 aligned with both tabs 116, as shown in FIG. 5B. It is to be understood that while alignment with two tabs is shown, a single tab alignment configuration or a multiple tab alignment configuration may also be used.

The nail gun 59 is then moved forward in the direction fo the arrow 120 to pass the channels 89 over the tabs 116. As the gun 59 continues forward, the follower plates 94 contact the tabs 116 and pivot upward and away from the braces 88 to swing the top sides 96 into contact with the horizontally extending legs 82 on the mounting plate 75. The follower plates 94 continue to pivot until the front side 98 bears against the top of the tabs 116, forcing the mounting plate 75 and attached linking arm 68 upward. When the linking arm 68 moves upward, actuation of the trigger 64 will then effect activation of the nail driving device 62 to eject a nail from the gun 59 and through the connector 118. Adjustment in the exact ejection position of the nail can be made by moving the mounting plate 75 upward on the linking arm 68 to delay ejection of the nail or downward on the linking arm 68 to advance ejection of the nail.

Figure 7A:
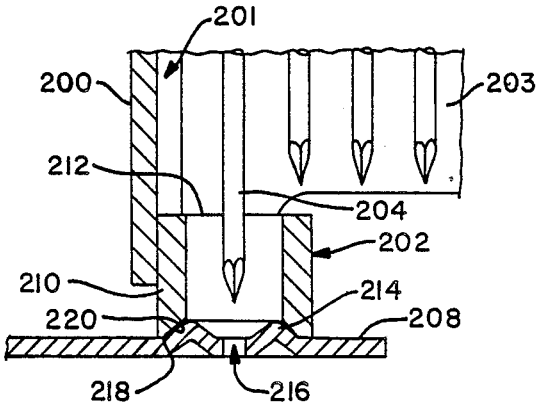
FIG. 7A is a cross-sectional side view of one embodiment of the sytem of the present invention illustrating an alignment foot cooperating with a raised ring on a connector.
Figure 7B:
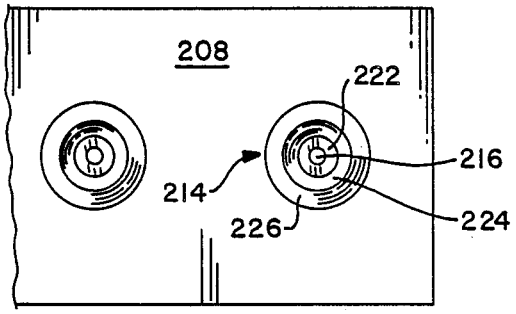
FIG. 7B is a top plan view of the connector of FIG. 7A.
Figure 7C:
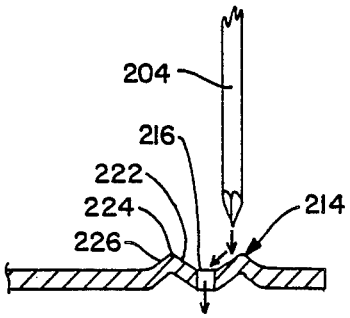
FIG. 7C is a side view in partial cross section showing a nail interacting with the raised ring on a connector.

FIGS. 7A–7C illustrate another embodiment of the present invention wherein a mounting plate 200, attached to the safety mechanism 201 of a nail gun 203, has an alignment foot 202 attached thereto. For purposes of this description, the safety mechanism 201 and nail gun 203 are identical to that described above; however, it is to be understood that other nail guns may be used as well. A nail 204 is shown in the process of being driven or ejected from the gun 203.

The mounting plate 200 may be an integral extension of the safety mechanism 201 or it may be separately attached as described above. The alignment foot 202 is formed to have a cylindrical wall 210 that is attached to the mounting plate 200 so that the nail 204 will pass through the longitudinal axial bore 212 of the foot 202. The connector 208 on which the foot 202 is placed has a raised ring 214 formed concentrically about an opening 216 in the top surface 209 of the connector 208. the foot 202 is sized and shaped to fit over the ring 214 such that the longitudinal axis of the axial bore 212 is aligned with the opening 216. To aid in placing the foot 202 in alignment with the ring 214, the bottom surface 218 of the foot 202 may be formed with an inclined portion 220 that is angled upward and inward to cooperate with the upward inclined surface of the ring 214.

In operation, the nail gun 203 is held over the connector 208 and the foot 202 is placed over the ring 214 to align the nail 204 with the opening 216. Downward pressure is applied to the gun 203 to force the safety mechanism 201 to move upward relative to the gun 203. At this point actuation of the trigger will cause the nail 204 to be ejected from the gun 203 and through the opening 216.

Should the nail 204 be slightly angled or misaligned with the opening 216, as shown in FIG. 7C, the inside surface of the ring 214 will guide the nail 204 toward the opening 216. Consequently, it is important that the ring 214 be formed to have an inside surface 222 that slopes downwardly from the top rim 224 of the ring 214. In addition, if the foot 202 is formed to have the inclined portion 220, it would be desireable, although not necessary, that the ring 214 be formed to have an outside surface 226 that inclines upwardly from the top surface 209 of the connector 208 to the rim 224 of the ring 214.

In embodiments where the connector 208 is formed from metal, such as steel, the ring 214 can be formed by a combination punch and die that creates the opening 216 and dimples the connector 208. If the connector 208 is formed from material other than metal, such as plastic, the ring 214 may be formed during the molding process. Furthermore, if a full ring is formed, the foot 202 may be constructed of one or more arcuate sections, or may consist of three downwardly projecting fingers, that are positioned to fit snugly around the ring 214.

Figure 8A:
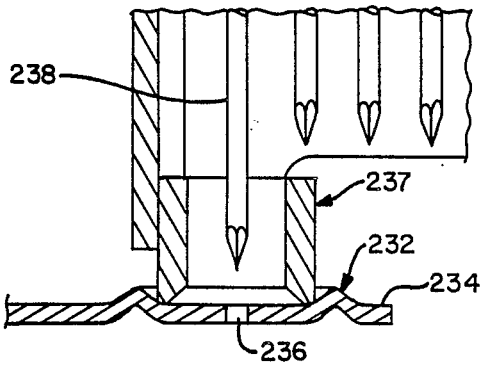
FIG. 8A is a cross-sectional side view of an alternative embodiment of the system of the present invention illustrating an alignment foot cooperating with the interior of a raised ring on a connector.
Figure 8B:
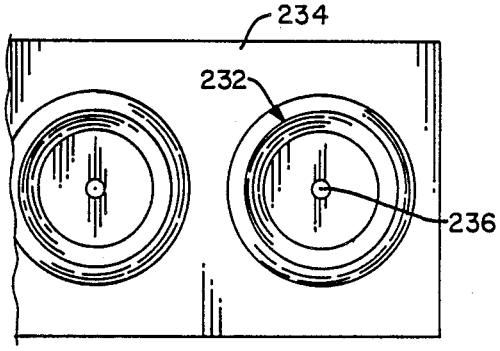
FIG. 8B is a top plan view of the connector of FIG. 8A.

FIGS. 8A and 8B illustrate another embodiment of the invention wherein an oversized ring 232 is formed on a connector 234 concentric with an opening 236 also formed in the connector 234. A foot 237, identical to the foot 202 described above, fits within the ring 232 to align a nail 238 with the opening 236. Operation of an associated nail gun is the same as described above.

Figure 9A:
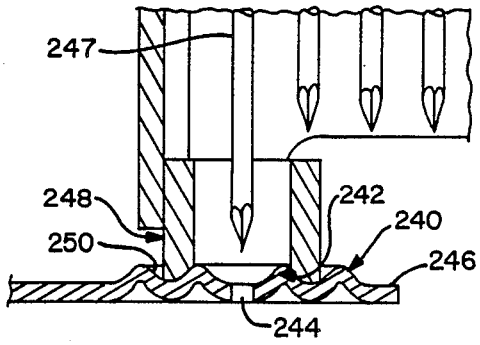
FIG. 9A is a cross-sectional side view of another embodiment of the present invention illustrating an alignment foot cooperating with a groove formed by a pair of concentric rings formed on a connector.
Figure 9B:
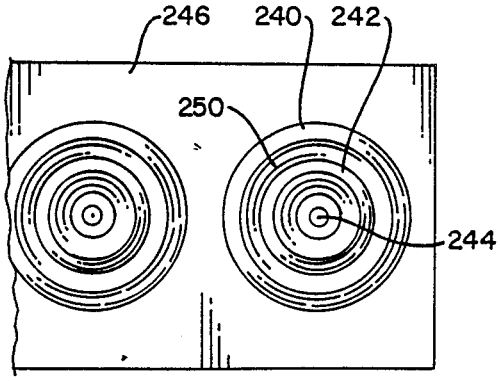
FIG. 9B is a top plan view of the connector of FIG. 9A.

FIGS. 9A and 9B illustrate yet another embodiment of the present invention, and, more particularly, another configuration of the connector, wherein an outer ring 240 and an inner ring 242 are formed concentrically about an opening 244 formed in a connector 246. The concentric rings 240 and 242 form a groove 250 therebetween. An alignment foot 248 attached to a gun 249, as described above, fits within the groove 250 to align the nail 247 with the opening 244.

Figure 10A:
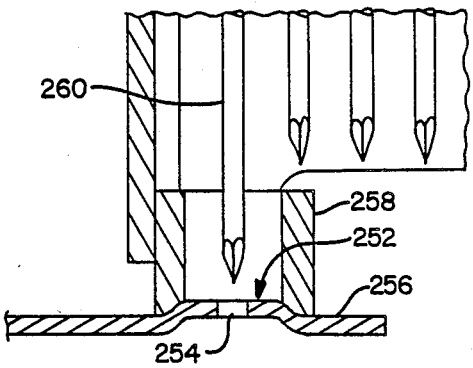
FIG. 10A is a cross-sectional side view of another embodiment of the present invention illustrating an alignment foot cooperating with a raised disk formed on a connector.
Figure 10B:
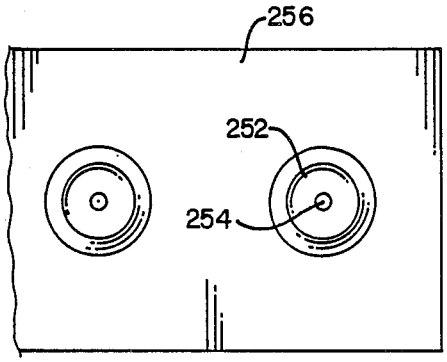
FIG. 10B is a top plan view of the connector of FIG. 10A.

FIGS. 10A and 10B illustrate a further embodiment of the present invention wherein a raised disk 252 is formed concentrically about an opening 254 formed in a connector 256. The alignment foot 258, identical to the alignment foot just described, fits around the outside perimeter of the raised disk 252 to align a nail 260 with the opening 254.

Figure 11A:
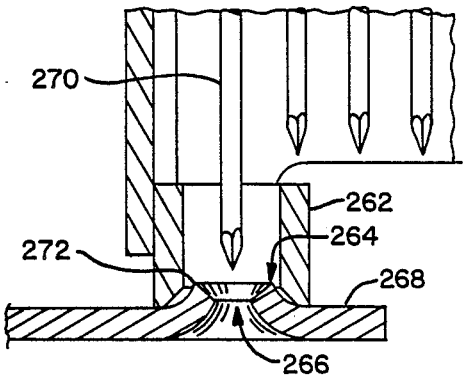
FIG. 11A is a cross-sectional side view of yet another embodiment of the present invention illustrating an alignment foot cooperating with a raised dimple on a connector.
Figure 11B:
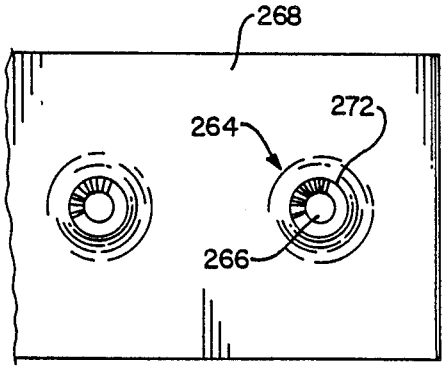
FIG. 11B is a top plan view of the connector of FIG. 11A.

Illustrated in FIGS. 11A and 11B are another embodiment of the present invention. A raised dimple 264 is formed concentrically with an opening 266 formed in a connector 268. The dimple 264 has a rim 272 that slopes downwardly and inwardly toward the opening 266 to aid in guiding a nail 270 to the topening 266 when the nail 270 is slightly inclined or misaligned. The alignment foot 262, attached to the gun 263 as described above, fits around the outside of the dimple 264 to align the nail 270 with the opening 266.

While a preferred embodiment of the present invention has been illustrated and described, it will be understood that various changes can be made therein without departing from the spirit and scope of the invention. For example, openings may be formed at more than two locations around each tab. In addition, the orthoganally formed walls may be used as a guide for the powered fastener tool. Consequently, the invention may be practic otherwise than as specifically described herein.

The embodiments of the invention in which an exclusive property or privilege is claimed are defined as follows:

1. A tool for driving fasteners through a predetermined position on a connector, the connector having one or more tab members projecting above a top surface on the connector, the tool comprising:

means for ejecting a fastener from the tool; and means for triggering said ejecting means, said triggering means including a follower means that cooperates with the one or more tab members on the connector to activate said ejecting means to eject a fastener from the tool and through the predetermined position on the connector.

2. The tool of claim 1 wherein said triggering means includes a manually operated trigger coupled to said ejecting means and to said follower means such that when said trigger is operated, said ejecting means will not eject a fastener until said follower means cooperates with the one or more tab members.

3. The tool of claim 2, wherein said follower means comprises a linking arm coupled to said trigger and a follower plate pivotally mounted to a foot that is rigidly attached to the tool, said follower plate cooperating with said linking arm such that as said follower plate contacts the one or more tab members on the connector, said follower plate pivots into contact with said linking arm to permit acutation of said trigger to cause activation of said ejecting means.

4. A connector for positioning fasteners that are driven by a powered fastener tool, the tool being activated by a trigger mechanism to eject a fastener therefrom, the connector comprising:

at least one wall, said at least one wall having a top surface on which the powered fastener tool is placed and a back surface on which structural members bear against; and means on said top surface for aligning the powered fastener tool with a predetermined position on said at least one wall when the powered fastener tool is brought into engagement with said aligning means.

5. The connector of claim 4, wherein said aligning means comprises a raised ring formed around said predetermined position and projecting above said front surface.

6. The connector of claim 5, wherein said ring is formed concentrically with said predetermined position.

7. The connector of claim 4, wherein said aligning means comprises a groove formed around said predetermined position.

8. The connector of claim 7, wherein said groove is formed concentrically about said predetermined position.

9. The connector of claim 4, wherein said aligning means comprises an outer raised ring and an inner raised ring formed about said predetermined position, said outer raised ring and said inner raised ring forming a groove therebetween.

10. The connector of claim 9, wherein said inner raised ring and said outer raised ring are formed concentrically about said predetermined position.

11. The connector claim 4, wherein said aligning means comprises at least one arcuate raised ridge formed about said predetermined position.

12. The connector of claim 4, wherein said aligning means comprises at least one arcuate groove formed about said predetermined position.

13. The connector of claim 4, wherein said aligning means comprises a raised dimple formed about said predetermined position.

14. The connector of claim 13, wherein said predetermined position comprises an opening formed in said at least one wall and said dimple includes a rim formed around said opening, said rim formed to slope inwardly and downwardly toward said opening to guide a misaligned fastener to said opening.

15. A device for positioning fasteners that are driven by a powered fastener tool, the tool being actuated by a trigger mechanism to cause a fasterner to be driven therefrom, the device comprising:

(a) at least one wall, said at least one wall having a front surface on which the powered fastener tool is placed and a back surface to which structural members bear against; and (b) means on said at least one wall for tripping the trigger mechanism to actuate the powered fastener tool to thereby drive a fastener into a predetermined location on said wall and into a structural member bearing against the back surface of said wall when the trigger mechanism is brought into engagement with said tripping means to thereby fasten the device to the structural member.

16. The device of claim 14, wherein said means for tripping the trigger mechanism comprises one or more tabs projecting from said at least one wall.

17. The device of claim 16, wherein said tabs are formed on the front surface of said at least one wall.

18. The device of claim 15, wherein said predetermined position comprises an opening in said at least one wall for receiving a fastener.

19. The device of claim 18, wherein said means for tripping the trigger mechanism comprises one or more tabs formed on said at least one wall.

20. The device of claim 19, wherein said one or more tabs are formed on the front surface of said at least one wall.

21. The device of claim 19, wherein said one or more tabs are spaced from said openings to enable the powered fastener tool to engage the tabs from more than one direction lateral to the tabs.

22. A device for positioning fasteners that are driven by a powered fastener tool, the tool being actuated by a trigger mechanism to cause a fastener to be driven therefrom, the device comprising:

(a) at least one wall, said wall having a front surface and a back surface;

(b) one or more openings formed in said wall, said openings being sized to permit passage of a fastener completely therethrough; and (c) means on said at least one wall for tripping the trigger mechanism to actuate the powered fastener tool to thereby drive a fastener completely through said opening and into a structural member bearing against the back surface of said wall when the trigger mechanism is brought into engagement with said tripping means.

23. The device of claim 22, wherein said means for tripping the trigger mechanism comprises one or more tabs projecting from said at least one wall.

24. The device of claim 23, wherein said tabs are formed on the front surface of said at least one wall.

25. In a tool for driving fasteners, the tool having a housing, a powered fastener driving device mounted in the housing, a trigger for actuating the powered fastener driving device, and a safety mechanism having a linking arm that cooperates with the trigger to permit activation of the powered fastener driving device when the linking arm is brought into positive engagement with a structural member or connector into which the fastener is to be driven, the improvement comprising an alignment foot attached to the safety mechanism that is sized and shaped to engage an alignment member on a conncector to align a fastener with a predetermined position on the connector prior to activation of the powered fastener driving device.

26. The improvement of claim 25, wherein said alignment foot comprises at least a portion of a cylinder.

27. The improvement of claim 25, wherein said alignment foot comprises a cylinder having an axial bore, said cylinder being attached to the linking arm such that a fastener will be driven axially through said bore when said powered fastener driving device is activated.

28. A system for positioning and driving fasteners, the system comprising:

(a) a connector, said connector comprising
at least one wall, said at least one wall having a top surface; and
means on said at least one wall for aligning a powered fastener tool with a predetermined position on said at least one wall and for tripping a triggering means on said tool; and (b) a powered fastener driving tool comprising
means for ejecting a fastener from said tool; and
means for triggering said ejecting means, said triggering means including a follower means that cooperates with said aligning and tripping means on said connector to enable activation of said ejecting means by said triggering means to eject a fastener from said tool and through said predetermined position on said connector.

29. The system of claim 28, wherein said means for aligning said tool and tripping said triggering means comprises one or more tabs formed on said at least one wall.

30. The system of claim 28, wherein said triggering means comprises a manually operated trigger coupled to said ejecting means, and said follower means is operatively coupled to said ejecting means such that when said trigger is operated, said ejecting means will not be activated until said follower means cooperates with said aligning and tripping means on said connector.

31. A system for positioning and driving fasteners, the system comprising:

(a) a connector, said connector comprising
at least one wall, said at least one wall having a top surface on which a powered fastener tool is placed and a back surface on which structural members bear against;
means on said top surface for aligning a powered fastener tool with one or more predetermined positions on said at least one wall; and (b) a powered fastener tool comprising
means for ejecting a fastener from said tool;
means for triggering said ejecting means, said triggering means including a manually operated trigger; and
an alignment member operatively coupled to said ejecting means and cooperating with said aligning means on said connector to enable activation of said ejecting means by said trigger only when said alignment member is in positive engagement with said aligning means.

32. The system of claim 31, wherein said alignment member comprises at least a portion of a cylinder.

33. The system of claim 31, wherein said alignment member comprises a cylindrically-shaped foot having an axial bore, said foot being mounted on said tool such that a fastener ejected from said tool will pass through said axial bore of said foot.

34. The system of claim 33, wherein said aligning means comprises one or more raised rings, each of said one or more raised rings being formed about one of said one or more predetermined positions.

35. The system of claim 33, wherein said aligning means comprises one or more pairs of concentric rings, each pair of said one or more predetermined positions, and each pair of said one or more pairs of concentric rings further comprising an outer ring and an inner ring and a groove formed therebetween.

* * * * *